United States Patent [19]

Yatchum et al.

[11] Patent Number: 4,533,798

[45] Date of Patent: Aug. 6, 1985

[54] CURRENT TRANSFER SHUNT ARRANGEMENT

[75] Inventors: Joseph W. Yatchum, McMurray; David F. Giegel, Pittsburgh, both of Pa.

[73] Assignee: McGraw-Edison Company, Rolling Meadows, Ill.

[21] Appl. No.: 616,845

[22] Filed: Jun. 4, 1984

[51] Int. Cl.[3] ..... H01H 19/00; H01H 1/12

[52] U.S. Cl. ..... 200/11 R; 200/11 TC

[58] Field of Search ..... 200/11 R, 11 B, 11 G, 200/11 H, 11 J, 11 K, 11 TC, 155 R, 237, 238, 241, 250, 260, 277, 279, 274, DIG. 45, 11 A, 67 DB, 248, 258

[56] References Cited

U.S. PATENT DOCUMENTS

| | | | |
|---|---|---|---|
| 3,162,731 | 12/1964 | Braunagel | 200/11 A |
| 3,196,221 | 7/1965 | Braunagel | 200/11 A |
| 3,564,180 | 2/1971 | Lyvang | 200/248 X |
| 3,571,540 | 3/1971 | Richards | 200/67 DB |
| 4,114,002 | 9/1978 | Hochgesang | 200/11 K X |

*Primary Examiner*—J. R. Scott

*Attorney, Agent, or Firm*—Jon Carl Gealow; James A. Gabala; Hugh M. Gilroy

[57] ABSTRACT

A high-current shunt is disclosed for carrying current between relatively fixed and movable terminals in a mechanism for controlling the transfer of electrical energy. In one embodiment a plurality of generally oval, flexible, ribbon-like electrical conductors are used to bridge the gap between two spaced apart coaxial base members. Each ribbon-like conductor is suspended between the two base elements so as to have a generally U-shaped configuration. By connecting the conductors to each base element at a single point, the two base elements may be rotated relative to each other to a limited degree. Stacking and nesting of the ribbon conductors increases the current carrying capability. Good electrical contact is established within a relatively small volume and relatively little force is required to rotate the two elements relative to each other.

20 Claims, 9 Drawing Figures

CURRENT TRANSFER SHUNT ARRANGEMENT

TECHNICAL FIELD

The present invention relates to mechanisms for controlling the flow of electrical power, in general, and to high current carrying flexible rotatable connections in such mechanisms, in particular.

BACKGROUND OF THE INVENTION

Equipment for controlling electrical power to or from other electrical equipment, such as the load tap-changer, no load tap changer or other switches in a power transformer, often includes mechanisms that direct the flow of high current between relatively fixed and movable electrical terminals or points in the equipment. Because electrical equipment takes on many forms, various solutions to the problem of transfering high current between two points, one of which is movable, have been offered by those skilled in the art. In mechanisms where a movable point or terminal rotates less than a complete revolution about an axis that is parallel to or coincident with an axis passing through a fixed point or terminal, an important design consideration is the torsional force developed in the electrical connection joining together the two terminals.

In addition to the torsional force consideration, there is the consideration of the electrical resistance of the connection between the two terminals or points. When high currents are involved, the electrical resistance consideration becomes very important. Thus, the electrical resistance of the connection between the two points should be as low as possible for a minimum power dissipation. It should be appreciated, however, that as torsional force increases better electrical contact is obtained. Thus, torsional force and electrical resistance are opposing considerations. What is needed is to optimize these two variables for a particular mechanism.

There is still another consideration. Compactness is always a desirable characteristic in electrical equipment. Not only is there material savings but, as the equipment becomes smaller, it is more easily located and capable of being used in a greater variety of situations. However, it often becomes difficult to provide a high current capability within a small volume, especially when high voltages are involved.

Various solutions have been proposed to the problem of providing a high current capability and a minimum torque load in a small volume. Most of these designs have employed "spring-loaded" contacts. An elementary design is described in U.S. Pat. No. 1,395,886; in that patent a rotatable arm carries two spring-loaded contacts which bridge the path between two sets of terminals. Similar designs are illustrated in U.S. Pat. Nos. 1,649,107 and 2,760,017. A circular cluster of contact elements, which are used to shunt two terminals or points which move relative to each other, is illustrated in U.S. Pat. Nos. 3,636,290 and 4,315,122. Spring-loaded contact assemblies are also shown in U.S. Pat. No. 3,959,616; a modern design is shown in U.S. Pat. No. 3,739,120. The relatively large size of such mechanisms when used in load tap changing transformers, particularly the three phase variety, is shown in U.S. Pat. No. 2,513,953. Even in those devices which incorporate a sliding contact arrangement, a continuous or unbroken connection is preferred to transfer current to at least one of the contact elements. Typically, braided strands of electrically conductive material (such as copper, aluminum or the like) are used to make this connection. This connection has a very low electrical resistance and, more importantly, essentially avoids the torque loading problem previously described. One difficulty with this design is that the cross-section often must be very large in order to handle the large currents which must be provided for. Some examples are provided in U.S. Pat. Nos. 3,143,621; 3,729,608; and 4,205,209. One relatively modern design is illustrated in U.S. Pat. No. 4,280,030. In this patent a flexible connection is provided by plurality of laminations which are formed in the shape of the letter "S". High current capability is provided by the laminations and torque loading is minimized. However, only a relatively limited degree of rotation or movement is possible. More importantly, the mechanism is still relatively large. Thus, the problem of providing a compact, efficient, low torque, low-resistant high current carrying capability between a set of contacts which move relative to each other in a high voltage environment remains to be solved.

SUMMARY OF THE INVENTION

In accordance with the present invention, a flexible, compact, low-resistant high current carrying electrical connection is disclosed for controlling electrical current flow between relatively fixed and movable terminals in an electrical apparatus. The compactness and high current carrying capability is achieved by utilizing a plurality of ribbon-like flexible electrical conductors suspended between two base plates which have a limited degree of rotational movement between each other. In one embodiment the electrical conductors are formed flat in the shape of an oval and then bent so that two opposite sides, which are disposed along the major axis of the oval, lie in two planes which are parallel to and at spaced distance apart from each other, and with the two opposite sides, which are disposed along the minor axis of the oval, lie parallel to each other and in the same plane. High current capacity is achieved by nesting the conductors within each other and at two sides of a plane lying in the axis of rotation.

In addition to compactness, the number of moving parts is substantially reduced over conventional designs. Moreover, sliding friction is not relied upon to transfer current. This eliminates the problems usually encountered with spring-loaded contacts and decreases the electrical resistance across the shunt. Other more common difficulties, such as dirt between the two spring-loaded surfaces and alignment problems, are eliminated. Other advantages and features of the present invention become apparent from the following description, the claims, and the drawings which show several embodiments of the invention.

DETAILED DESCRIPTION

Figure 1:
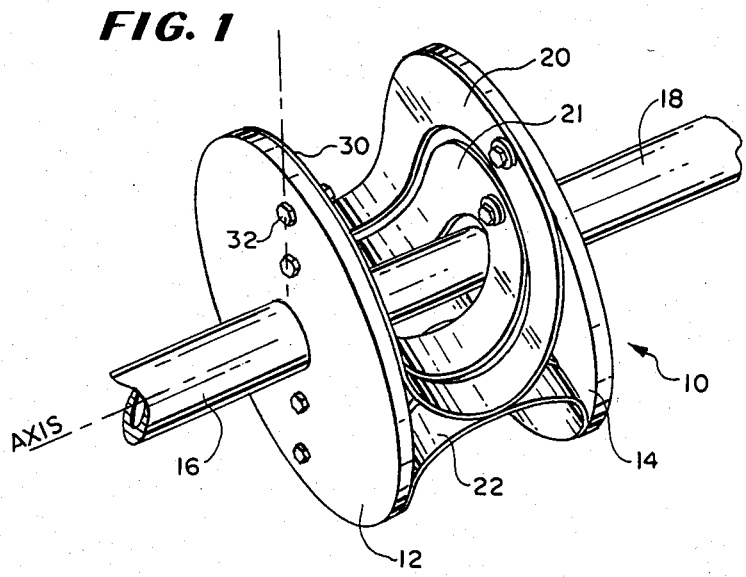
FIG. 1 is a perspective view depicting the current transfer shunt that is the subject of the present invention.

While this invention is a sample of embodiment of many different forms, there is shown in the drawings and will be herein described in detail several specific embodiments with the understanding that the present invention is to be considered an exemplification of the principles of the invention and is not intended to limit the invention to those specific embodiments illustrated.

Turning to the drawings, FIG. 1 illustrates the current shunt 10 that is the subject of the present invention. Specifically, two generally flat circular base plates 12 and 14 are shown which are parallel to and spaced apart from each other. For purposes of generality, it can be assumed that the right-hand base plate 14 is fixed in position relative to the left-hand base plate 12. The left-hand base plate 12 is joined to a shaft 16. The right-hand base plate 14 is also mounted on a shaft 18 whose axis is generally coincident with the axis of rotation of the left-hand shaft 16. Without loss of generality, it can be assumed that the right-hand shaft 18 extends to the left beyond the right-hand base plate 14 and is journaled into the left-hand shaft 16. This is to maintain an essentially coaxial relationship between the two shafts. The two base plates 12 and 14 are bridged or joined together by four generally oval flat, flexible ribbon-like electrical conductors or current carrying elements 20, 21, 22, and 23.

Each of the four conductors 20, 21, 22 and 23 is suspended between and connected to the two base plates 12 and 14 at two opposite points. In the drawings, threaded fasteners 32 are used to join the ribbon conductors to the base plates. Other devices may be used, such as rivets. This connection is made generally at the center of each semi-circular side with the plane of each semi-circular side disposed generally parallel to and spaced apart from each other and at right angles to the axis of two shafts 16 and 18. When viewed from a position along one of the edges of one of the two generally parallel sides (see FIG. 4A), the conductors assume a generally U-shaped or bow-shaped configuration.

Figure 6A:
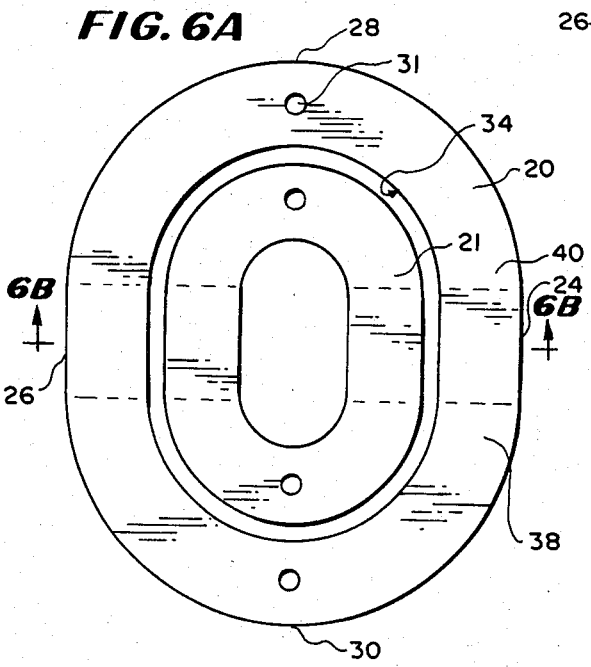
FIG. 6A is a plan view of two of the flexible current elements shown in FIG. 1 when the elements are folded flat.
Figure 7:
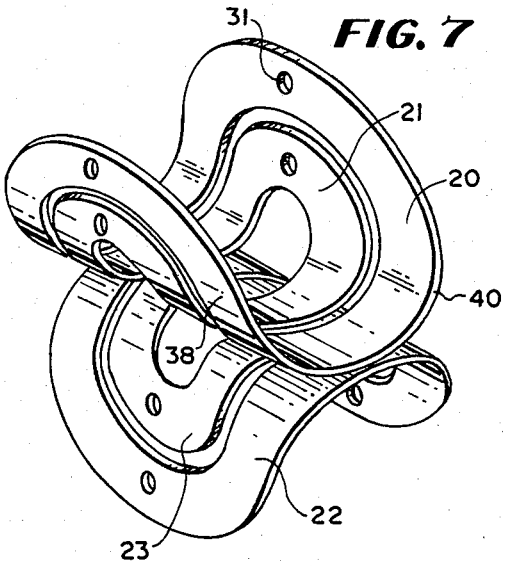
FIG. 7 is perspective view of the shunt shown in FIG. 1 with the relatively rigid base members and shaft portions removed.
Figure 6B:
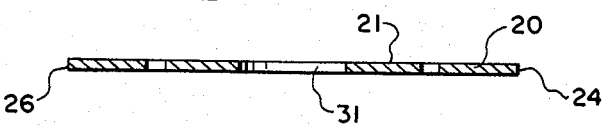
FIG. 6B is a cross-sectional view of the current elements shown in FIG. 6A taken along line 6B—6B.

Turning to FIG. 6A and to one of the conductors 20, the conductors, when flattened, defines two generally parallel and opposite sides 24 and 26 and two semi-circular complementary sides 28 and 30. The two semi-circular complementary sides 28 and 30 are disposed between and connected to the two parallel sides 24 and 26.

Figure 4A:
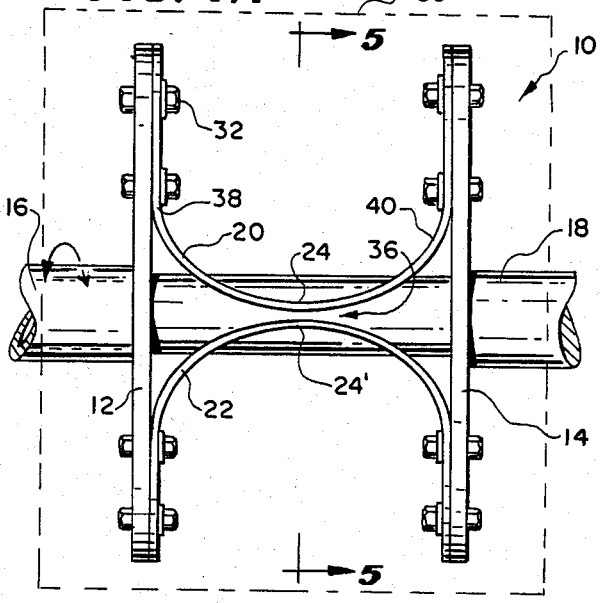
FIG. 4A is a side elevational view of the shunt shown in FIG. 1.
Figure 4B:
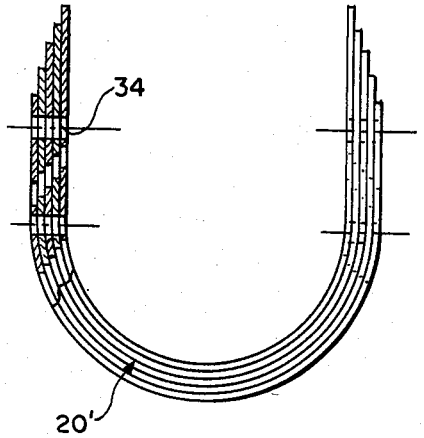
FIG 4B is a partial, cross-sectional side view of the current elements joining together the two relatively rigid members of the shunt.

While only one ribbon conductor would be needed to establish electrical contact between two base plates 12 and 14, increased current-carrying capability is provided by nesting two oval, flat, flexible electrical conductors within each other (see FIG. 6A) or by stacking the oval, flat, flexible electrical conductors one on top the other (see FIG. 4B). The cross-sectional area of the ribbon-like conductors is primarily determined by the current that the shunt 10 will be required to handle. The ribbon conductors are perferably formed from relatively thin copper laminations; however, other electrically conductive materials may be used, such as aluminum or metal alloys. When the conductors are nested (see FIG. 6A), a gap 34 should be provided between the inner diameter of the outer conductor 20 and the outer diameter of the inner conductor 21. The reason for this gap will become apparent from discussion which follows. When the conductors are stacked (see FIG. 4B), it will be observed that, because of the thickness of the conductors, the holes 31 through which the fasteners 32 are inserted, must be staggered across the semi-circular sides 28 and 30 so that they will be aligned when the stack of conductors 20′ are bent in their U-shaped configuration (See FIG. 4A). Finally it should be noted that although a gap 36 is shown between the two large ribbon conductors 20 and 22 (see FIG. 4A), a gap between opposite conductors is not necessary; the oppositely disposed conductors may be in contact with each other.

It should become apparent from the study of FIG. 4A that by arranging the conductors on two sides of the axis of rotation, with the parallel sides 24 and 24′ disposed against each other, the conductors occupy a volume largely determined by the space between the two base plates 12 and 14. This effectively allows one to pass large currents within a relatively small space. In a power class tap-changing transformer, because of the high voltages involved (i.e., 500 kv, 60 HZ from taps to ground), the compact design allows one to enclose the shunt 10 within an aluminum shield 50 to prevent corona which could emanate from sharp edges of the parts of the tap changing switch. Those skilled in the art know that the shape and size of the shield 50 is dictated by the space available and the voltage stresses imposed. The shields could be made as fabrications or aluminum spinnings. Thus, the shunt 10 is of special benefit to such applications.

Figure 2:
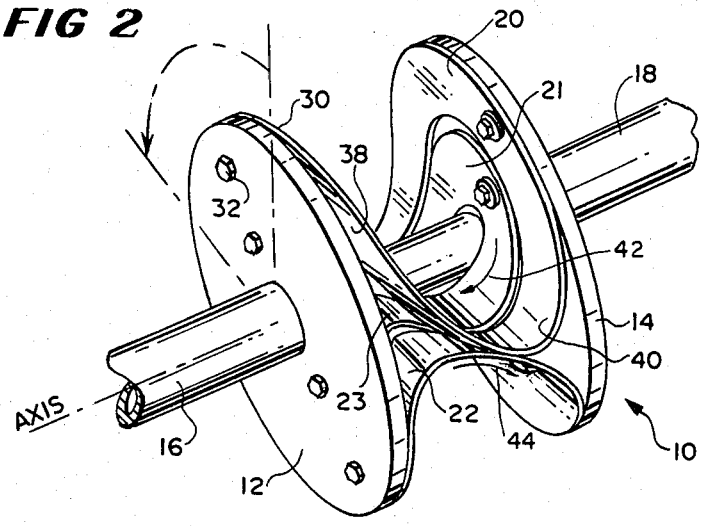
FIG. 2 is a perspective view of the shunt shown in FIG. 1 with the left-hand element rotated counter-clockwise through an arc of approximately 45 degrees.
Figure 3:
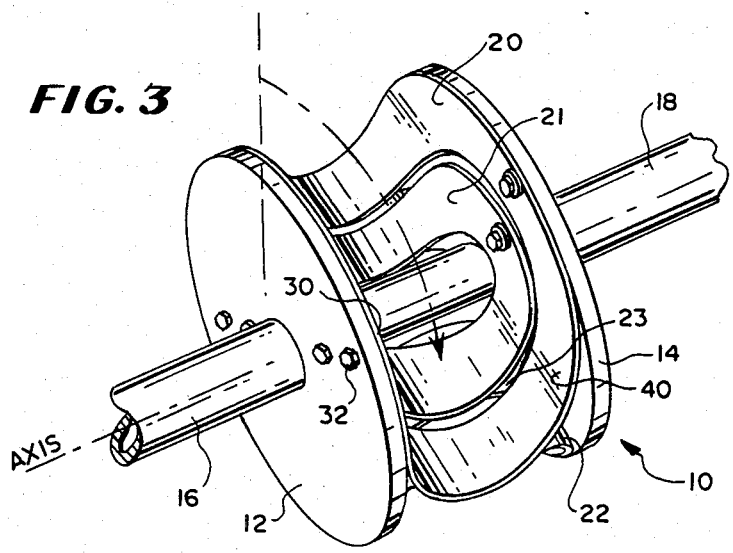
FIG. 3 is a perspective view of the shunt shown in FIG. 1 with the left-hand element rotated clockwise through an arc approximately 45 degrees.
Figure 5:
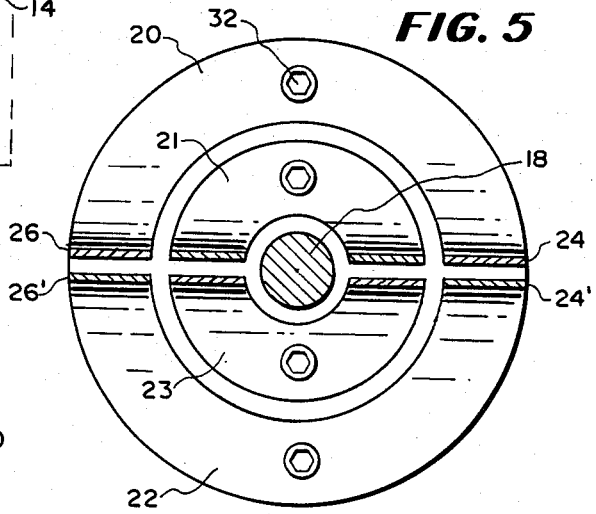
FIG. 5 is a partial, cross-sectional side view of the shunt shown in FIG. 4A as viewed along line 5—5.

Now that the principal components of the invention have been described, the operation of the shunt 10 will be discussed in detail. In FIG. 1 the elements of the shunt are shown when the two base plates 12 and 14 are aligned with each other. Since each of the four ribbon-like conductors 20, 21, 22 and 23 function in essentially the same manner, only the movements of one of the conductors 20 needs to be explained in detail. Now when the left-hand base plate 12 rotates counterclockwise, one end 38 of each of the two semi-circular sides 28 and 30 (see FIG. 2) is pulled away from one of the base plates (here the left-hand base plate 12). Consequently, the adjacent end 40 of the opposite semi-circular side is urged against the other base plate 14. Similarly, when the left-hand base plate 12 is rotated clockwise (see FIG. 3) from the neutral position (see FIG. 1), one end 38 of each semi-circular side (here side 30) is urged against its corresponding base plate 12 and the adjacent end 40 on the opposite circular side is pulled away from its base plate 14. Effectively the adjacent parallel sides (24 and 24′ on the right side, and 26 and 26′ on the left side noting FIG. 5) of the two corresponding conductors 20 and 22 appear to "move" in opposite directions relative to each other (see arrows 42 and 44 in FIG. 2).

While the invention has been described in conjuction with several specific embodiments, it is evident that there are other alternatives, modifications and variations which should be apparent to those skilled in the art in light of the foregoing description. For example, although an unbroken oval ribbon-like conductor was used to bridge the gap between the two base plates, other shapes, such as an elliptical shape can perform the same function. Accordingly, it is intended to cover all such alternatives, modifications and variations as set forth within the spirit and scope of the appended claims.

I claim:

1. A current transfer shunt, comprising:
(a) a shaft defining an axis of rotation;
(b) base means for rotatably mounting said shaft;
(c) a first support plate carried by said shaft at generally right angles to said axis of said shaft;
(d) a second support plate fixedly carried by said base means and disposed generally parallel to and axially separated from said first support plate; and
(e) at least one generally oval, flat, flexible electrical conductor which when flattened defines two generally parallel and opposite sides and two semi-circular complementary sides disposed between and connected to said two parallel sides, said one conductor being suspended between and connected to said first and second support plates generally at the center of each semi-circular side with the plane of said semi-circular sides disposed generally parallel to and spaced apart from each other and at right angles to said axis of said shaft,
whereby upon rotation of said shaft one end of each semi-circular side is pulled away from one of said first and second support plates and the opposite end is urged against the same support plate.

2. The shunt set forth in claim 1, further including a second generally oval, flat, flexible conductor which when flattened defines two parallel and opposite sides and two semi-circular complimentary sides disposed between and connected to said parallel sides, said second conductor being disposed opposite to said one conductor and being suspended between and connected to said first and second support plates such that the parallel sides of said second conductor are bowed towards and in contact with the parallel sides of said one conductor,
whereby upon rotation of said shaft the parallel sides of said one conductor roll relative to the parallel sides of said second conductor.

3. The shunt set forth in claim 1, wherein said one conductor is formed from a plurality of laminations stacked on top of each other.

4. The shunt set forth in claim 1, wherein said one conductor is connected to said first support plate by a removable fastener.

5. The shunt set forth in claim 4, wherein said removable fastener is a nut and bolt combination.

6. The shunt set forth in claim 1, wherein one of said semi-circular sides of said one conductor defines an aperture intermediate its ends and said one conductor is connected to said first support plate by a removable fastener passing through said aperture.

7. The shunt set forth in claim 1, further including a second generally oval, flat, flexible conductor which when flattened defines two parallel and opposite sides and two semi-circular complimentary sides disposed between and connected to said parallel sides, said parallel opposite sides of said second conductor being parallel to the parallel sides of said first conductor, said first conductor and said second conductor each defining an inside an d outside perimeter with the outside perimeter of said second conductor being less than the inside perimeter of said first conductor such that said second conductor fits within and is spaced apart from said first conductor, said second conductor being suspended between said first and second support plates in a manner similar to that in which said first conductor is suspended.

8. The shunt set forth in claim 1, wherein said first support plate and said second support plate are circular in shape.

9. The shunt set forth in claim 1, wherein said base means is formed from a second shaft whose axis is parallel to the axis of the shaft to which said first support plate is carried.

10. The shunt set forth in claim 1, wherein said one conductor when flat defines a major diameter and wherein said first and second support plates are spaced apart at a distance generally less than said major diameter.

11. Apparatus, comprising:
(a) a shaft;
(b) a base for rotatably mounting said shaft;
(c) a first plate connected to said shaft so as to be perpendicular to the axis of said shaft;
(d) a second plate which is fixed in position relative to said first plate and which is disposed in a plane generally parallel to and at a spaced distance from said first plate; and
(e) a generally circular ribbon conductor connected at two opposite points to said first plate and said second plate respectively and suspended between said first and second support plate, with that portion of said ribbon conductor intermediate said two opposite points bowed towards the axis of said shaft.

12. The apparatus set forth in claim 11, further including:
a second circular ribbon conductor connected at two opposite points to said first support plate and said second support plate with that portion intermediate said two opposite points being disposed towards and in contact with said intermediate portion of said first conductor.

13. The apparatus set forth in claim 11, wherein said ribbon conductor is connected to said first plate and said second plate at two opposite and adjacent points on said first plate and said second plate respectively.

14. A shunt comprising:
(a) a shaft;
(b) means for rotatable mounting said shaft;
(c) a first conductor mounted on said shaft at a right angle to the axis of said shaft;
(d) a second conductor which is fixed in position relative to said first conductor and which is disposed generally parallel to and at a spaced distance from said first conductor; and
(e) a first flexible ribbon conductor connected at two opposite points to said first conductor and said second conductor and suspended between said first conductor and second conductor with that portion of said ribbon conductor intermediate said two opposite points disposed towards the axis of said shaft so as to form an arc.

15. The shunt set forth in claim 14, wherein:
said first ribbon conductor includes two arms, each of said arms defining two opposite ends and a mid-section disposed intermediate said two opposite ends; and wherein each of said mid sections is disposed on either side of the axis of said shaft.

16. The shunt set forth in claim 14, further including a second flexible ribbon conductor disposed generally as the mirror image of said first flexible ribbon conductor.

17. The shunt set forth in claim 14, wherein said first flexible ribbon conductor is in the form of a closed loop.

18. The shunt set forth in claim 17, wherein said first flexible ribbon conductor when layed flat is generally elliptical in shape.

19. The shunt set forth in claim 18, wherein said first flexible ribbon conductor defines a major diameter and a minor diameter, and wherein said first conductor and said second conductor are spaced apart a distance generally less than said major diameter.

20. The shunt set forth in claim 14, wherein said first flexible ribbon conductor has an arc length greater than the straight line distance separating said two opposite points.

* * * * *